United States Patent [19]

Kabelitz et al.

[11] Patent Number: 4,978,276

[45] Date of Patent: Dec. 18, 1990

[54] PUMP STAGE FOR A HIGH-VACUUM PUMP

[75] Inventors: Hans-Peter Kabelitz; Winfried Kaiser; Hans-Guenter Stueber, all of Cologne, Fed. Rep. of Germany

[73] Assignee: Leybold Aktiengesellschaft, Fed. Rep. of Germany

[21] Appl. No.: 419,194

[22] Filed: Oct. 10, 1989

[30] Foreign Application Priority Data

Oct. 10, 1988 [EP] European Pat. Off. ..... 88116749

[51] Int. Cl.[5] ..... F04D 29/00; F04D 19/04

[52] U.S. Cl. ..... 415/55.3; 415/73; 415/76

[58] Field of Search ..... 415/90, 71, 72, 73, 415/74, 75, 76, 55.1, 55.2, 55.3, 55.4, 55.5, 55.6, 55.7, 143, 151; 416/180

[56] References Cited

U.S. PATENT DOCUMENTS

| | | | |
|---|---|---|---|
| 109,926 | 12/1870 | Monroe | 415/75 |
| 2,941,780 | 6/1960 | Nuell et al. | 415/143 |
| 3,697,190 | 10/1972 | Haentjens | 415/219.1 |
| 4,332,522 | 6/1982 | Saulgeot | 415/90 |

FOREIGN PATENT DOCUMENTS

| | | | |
|---|---|---|---|
| 0142208 | 5/1985 | European Pat. Off. . | |
| 2189295 | 10/1987 | United Kingdom | 415/90 |

*Primary Examiner*—Edward K. Look
*Assistant Examiner*—Hoang Nguyen
*Attorney, Agent, or Firm*—Hill, Van Santen, Steadman & Simpson

[57] ABSTRACT

A high-vacuum pump includes a plurality of pump stages, each of which has a rotor and a stator. In one of the pump stages, either the rotor or the stator is provided with a structure that effects the gas conveying includes radially extending webs whose pitch and width decrease from the suction side of the pump stage to the thrust side of the pump stage.

20 Claims, 2 Drawing Sheets

PUMP STAGE FOR A HIGH-VACUUM PUMP

TECHNICAL FIELD

The invention is directed to a pump stage for a high-vacuum pump including a rotor and a stator surrounding the rotor, wherein either the rotor or the stator is provided with a structure effecting gas conveying.

BACKGROUND OF THE INVENTION

High-vacuum pumps often include molecular pump stages or turbomolecular pump stages. In molecular pumps, a moving rotor wall and a resting stator wall are designed and positioned such that, in operation, they impart predetermined directional forces to convey gas molecules situated therebetween. As a rule, either the rotor wall or the stator wall is equipped with spiral or helical depressions or projections that determine the direction of the forces transmitted, and thus the conveying direction of the gas. Turbomolecular pump stages include stator paddles and rotor paddles arranged to resemble a turbine. The paddles transmit the desired conveying forces onto the gas molecules in a predetermined conveying direction.

Turbomolecular pump stages have a relatively low compression ratio (defined as the ratio of the pressure at the thrust face to the pressure at the suction face) but have a relatively high pumping capacity (pump speed, volume flow per time unit). Their manufacture and assembly, however, is involved and expensive, since a great number of pump stages (rotor and stator stages) are required in order to achieve an adequate compression. Molecular pump stages have a relatively high compression ratio; their pumping capacity, however, is poor.

European Patent Application No. 142 208 discloses that the pumping capacity of a molecular pump can be improved when a separate pump stage is provided at the suction side of the molecular pump. The separate pump stage includes a helical projection at the stator side. This projection is the continuation of a helical projection of the molecular pump in the direction of the suction side. The rotor side of the helical projection includes paddle blades extending radially and parallel to the rotational axis of the rotor. A pump stage of this type is relatively involved to manufacture, since it requires structure both at the rotor side as well as at the stator side. Further, the compression of these pump stages is very low.

SUMMARY OF THE INVENTION

It is, therefore, an object of the present invention to provide a pump stage that has improved pumping properties and is relatively simple to manufacture and maintain.

This and other objects are inventively achieved by providing structure effecting the gas conveying that is composed of radially extending webs whose pitch and whose width decrease from the suction side to the thrust side of the pump. In comparison to standard screw-pump stages, a pump stage embodying the present invention has both better compression as well as high pumping capacity, particularly with relatively high pressures at the suction side. Since the present invention provides that either only the stator or the rotor is equipped with webs, its manufacture, assembly, and service are considerably simpler, and the pump assembly is more compact, in comparison to turbomolecular pump stages.

Due to its special pump properties, the pump stage of the present invention is especially suited to be combined with a screw-pump stage, and particularly with two screw-pump stages. With respect to compression, pumping capacity, and ultimate pressure, a high-vacuum pump of this type achieves pump properties comparable to those of a corresponding turbomolecular pump. Furthermore, the pump stage of the present invention has the advantage that it is capable of operating at higher pressures, up to pressures encountered in the viscous flow range. The present invention achieves these operating characteristics while providing a reduction in the structure and energy necessary for generating forepressure in previously known pump arrangements.

Other objects and advantages of the present invention will become apparent upon reference to the accompanying description when taken in conjunction with the following drawings.

DESCRIPTION OF THE PREFERRED EMBODIMENTS

Figure 1:
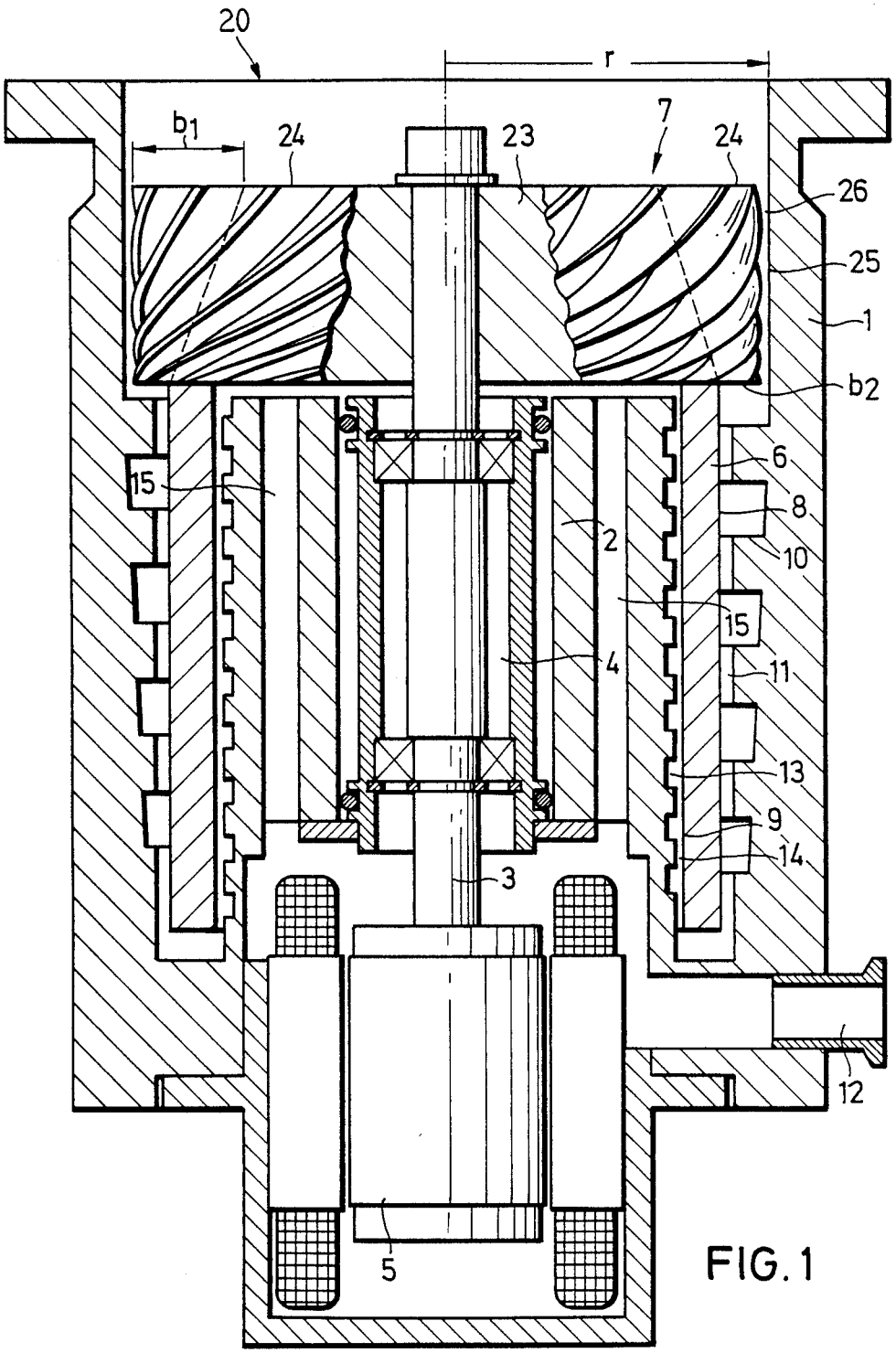
FIG. 1 is a sectional view, partially broken away, of a high-vacuum pump embodying the present invention.

The high-vacuum pump of FIG. 1 includes an outer housing 1 having a central, inwardly projecting bearing bush 2. The shaft 3 is supported in the bearing bush 2 with a spindle bearing 4. The drive motor 5 and the rotor system 6, 7 are coupled to the shaft 3.

The one-piece rotor system has differently configured rotors 6 and 7. The rotor 6 is cylindrical with smooth outer and inner surfaces 8, 9. Surrounding the surface 8, the inner surface of the housing 1 is equipped with a screw thread 10 and thus forms the stator of a first molecular screw-pump stage. The surface 8 and the screw-thread 10 from pump-active surfaces of this threaded pump stage, and help to convey molecules through a pump gap 11 in the direction of the discharge outlet 12.

Near the inner surface 9 of the rotor 6, the outside of the bearing bush 2 is provided with a threaded section 13, and thus forms a stator for a second screw-pump stage. The threaded section 13 and the inner surface 9 form pump-active surfaces of the further threaded pump stage to convey gas through the pump gap 14. The gases conveyed from bottom to top of the pump stage through the pump gap 14 flow through bores 15 in the bearing bush 2, and on to the discharge outlet 12.

An additional pump stage 20 forming a part of the present invention precedes the threaded pump stages. The pump stage 20 includes a rotor 7 that is composed of a conically shaped hub part 23 and of the webs 24. Together with the stator wall 25 that surrounds them, the webs 24 form a pump stage 20 in housing 1. Gas molecules that proceed between the individual webs 24 or into the gap 26 are conveyed by the pump stage 20 in the direction of the pump gap 11 of the first molecular pump stage.

In the illustrated exemplary embodiment, the webs 24 are provided on the conical hub part 23 and rotate with the rotor system 6, 7. Alternatively, the webs 24 could be provided on the stator wall 25. In such an embodiment, the gap 26 would be situated between the outer surface of the hub part (which would be smooth in this alternative) and the inside edges of the webs. Optimally, the width of the gaps 11, 14 and 26 should be small. In molecular pump stages, such gaps are usually a few tenths of a millimeter in width.

Figure 2:
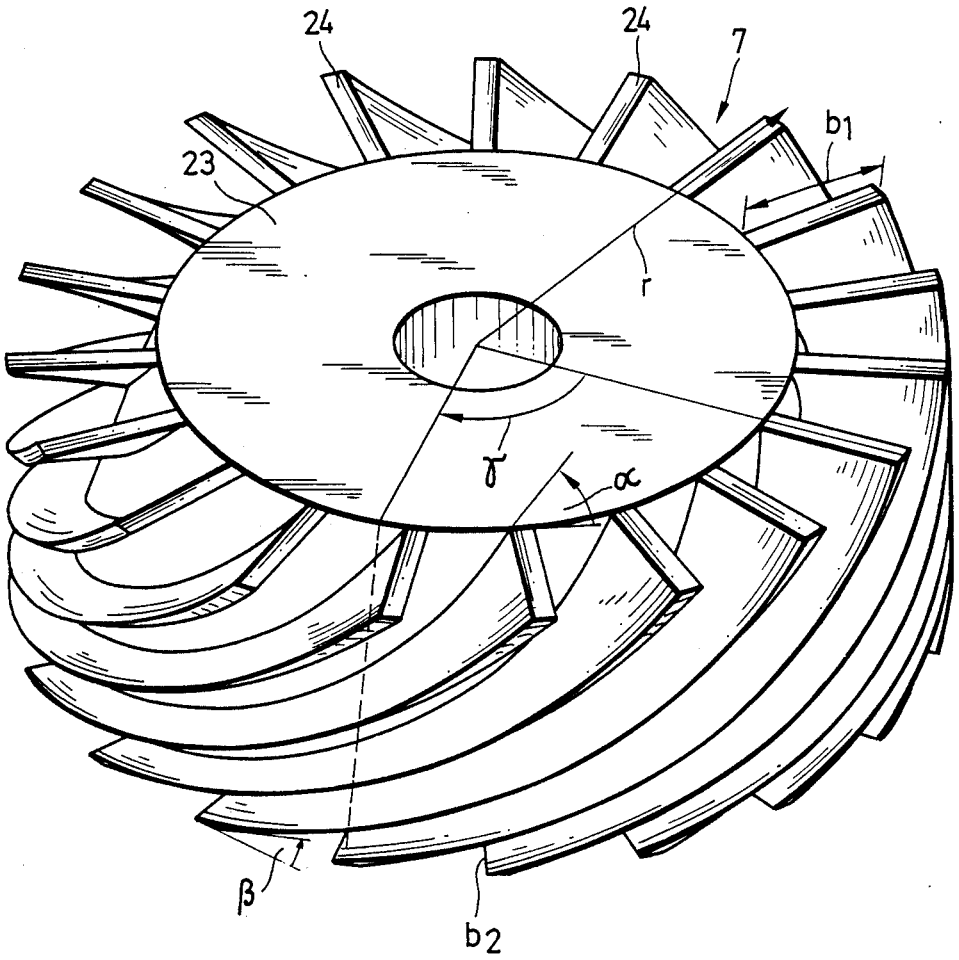
FIG. 2 is a perspective view of the rotor of the pump stage of FIG. 1.

Details of the design of the rotor 7 of the pump stage 20 may be seen in FIG. 2. The outer radius r of the rotor 7 is practically identical to the radius of the cylindrical inside stator wall 25. The rotor is slightly undersized to provide a pump gap 26. At the suction side, the webs 24 have a slope or "attack angle" $\alpha$ of about 45°.

The width $b_1$ of the upper surface of the webs 24 corresponds to about one-third of the radius r (in practice, "r" is around 50 through 60 mm). Given these size relationships, the annular surface (gas intake surface) defined by the width $b_1$ of the webs 24 makes up more than 50% of the area of the rotor end face.

At the thrust side, the webs 24 have an attack angle $\beta$ of about 15°. The width $b_2$ of the lower surface of webs 24 corresponds to about one-tenth of the radius r. The pump channels formed by the hub part 23, the webs 24 and the stator wall 15 discharge into the adjacent threaded pump stage 10.

In the illustrated preferred embodiment, nineteen webs 24 are uniformly distributed over the circumference of the conical hub part 23. Each web 24 extends over the angle $\gamma$. This angle $\gamma$ is preferably around 90°.

Although the present invention has been described with reference to a specific embodiment, those of skill in the art will recognize that changes may be made thereto without departing from the scope and spirit of the invention as set forth in the appended claims.

We claim:

1. A pump stage for a high-volume pump comprising the following:

a rotor section and a stator section, wherein either the rotor or the stator is provided with web means for effecting gas conveying; and wherein said web means comprises radially extending webs having a pitch and width that decrease from a suction side of said pump stage to a thrust side of said pump stage;

wherein the ratio of a radius of a circle defined by an inner surface of a wall of said stator to a first web width at the suction side of said pump stage is between 2:1 and 5:1;

wherein a second ratio, that of the radius of a circle defined by the inner surface of the stator wall to a second web at the thrust side of the pump stage, is between 10:1 and 12:1; and wherein the pitch of the webs decreases from the suction side to the thrust side from an attack angle of between 40° and 50°, to an attack angle of between 10° and 20°.

2. A pump stage according to claim 1, wherein said ratio is 3:1.

3. A pump stage according to claim 1, wherein said pitch decreases from an attack angle of 45° to an attack angle of 15°.

4. A pump stage according to claim 1, further wherein each web extends over about 90° of the circumference of the rotor.

5. A pump stage according to claim 4, further wherein said rotor is frustoconical, and between ten and twenty webs lying parallel to one another are arranged uniformly on the circumference of the rotor.

6. A pump stage according to claim 1, further wherein said pump stage is combined with at least one threaded pump stage comprising screw-threads, and said rotors of the pump stage and said screw-threads are arranged coaxially on a common shaft.

7. A pump stage according to claim 6, further wherein said shaft is supported in a bearing bush, and said at least one threaded pump stage comprises the following:

a cylindrical rotor having inner and an outer surface;

wherein the outer surface of said cylindrical rotor, together with an inner surface of a housing of said at least one pump stage, forms a first threaded pump stage; and wherein the inner surface of said cylindrical rotor, together with an outer surface of said bearing bush, forms a second threaded pump stage.

8. A pump stage according to claim 7, further wherein said pump stages are connected to a discharge outlet via bores in said bearing bush.

9. A pump stage according to claim 6, further wherein said shaft is supported in a bearing bush, and said at least one threaded pump stage comprises the following:

a cylindrical rotor having inner and an outer surface;

wherein the outer surface of said cylindrical rotor, together with an inner surface of a housing of said at least one pump stage, forms a first threaded pump stage; and wherein the inner surface of said cylindrical rotor, together with an outer surface of said bearing bush, forms a second threaded pump stage.

10. A pump stage according to claim 9, further wherein said pump stages are connected to a discharge outlet via bores in said bearing bush.

11. A pump stage for a high-vacuum pump comprising the following:

a rotor section and a stator section, wherein either the rotor section or the stator section is provided with web means for effecting gas conveying; and said web means comprises radially extending webs having a pitch and a width that decrease from a suction side of said pump stage to a thrust side of said pump stage from an attack angle of between 40° and 50°, to an attach angle of between 10° and 20°.

12. A pump stage according to claim 11, wherein the ratio of a radius of a circle defined by an inner surface of a wall of said stator to a first web width at the suction side of said pump stage is between 2:1 and 5:1.

13. A pump stage according to claim 12, wherein said ratio is 3:1.

14. A pump stage according to claim 11, wherein a ratio of a radius of a circle defined by an inner surface of a wall of said stator to a web at the thrust side of said pump stage is between 10:1 and 12:1.

15. A pump stage according to claim 11, wherein said pitch decreases from an attack angle of 45° to an attack angle of 15°.

16. A pump stage according to claim 11, further wherein each web extends over about 90° of the circumference of the rotor.

17. A pump stage according to claim 16, further wherein said rotor is frustoconical, and between ten and twenty webs lying parallel to one another are arranged uniformly on the circumference of the rotor.

18. A pump stage according to claim 11, further wherein said pump stage is combined with at least one threaded pump stage comprising screw-threads, and said rotors of the pump stage and said screw-threads are arranged coaxially on a common shaft.

19. A pump stage according to claim 11, wherein said pump stage comprises a turbomolecular pump stage of a high-vacuum pump.

20. A high-vacuum pump comprising the following:

a first pump stage including a cylindrical rotor mounted for rotation on a shaft, said cylindrical rotor having at least one surface forming a part of said first pump stage;

a second pump stage upstream of said first pump stage and including a second rotor mounted on said shaft, wherein said rotor is associated with a plurality of radially extending webs having a pitch and width that decrease from a suction side to a thrust side of said vacuum pump, wherein the pitch of the webs decreases from the suction side to the thrust side from an attack angle of between 40° and 50°, to an attach angle of between 10° and 20°.

* * * * *